United States Patent [19]

Grunert

[11] 4,334,723

[45] Jun. 15, 1982

[54] DENTAL CABINET

[75] Inventor: Hans C. Grunert, Adelberg, Fed. Rep. of Germany

[73] Assignee: Sybron Corporation, Rochester, N.Y.

[21] Appl. No.: 147,918

[22] Filed: May 8, 1980

[51] Int. Cl.[3] ..... A47B 77/08; E03C 1/04

[52] U.S. Cl. ..... 312/209; 312/223; 312/228; 312/278; 4/192; 4/543

[58] Field of Search ..... 312/209, 228, 229, 233, 312/278, 195; 4/192, 543, 548, 549, 584, 589, 553; 206/363

[56] References Cited

U.S. PATENT DOCUMENTS

| | | | |
|---|---|---|---|
| 482,285 | 9/1892 | Toohey | 312/278 |
| 1,435,015 | 11/1922 | Lidberg | 312/209 |
| 2,574,164 | 11/1951 | Baay | 312/223 |
| 3,125,385 | 3/1964 | Friedman | 312/223 |
| 3,304,609 | 2/1967 | Horowitz et al. | 312/209 |
| 3,524,256 | 8/1970 | Barker | 312/209 |
| 3,765,036 | 10/1973 | Dykstra | 4/192 |
| 3,770,334 | 11/1973 | Weber | 312/223 |
| 3,828,695 | 8/1974 | Skarky | 312/209 |

FOREIGN PATENT DOCUMENTS

| | | | |
|---|---|---|---|
| 597271 | 1/1948 | United Kingdom | 312/228 |

*Primary Examiner*—Victor N. Sakran

*Attorney, Agent, or Firm*—Theodore B. Roessel; Roger Aceto

[57] ABSTRACT

A dental cabinet, suitable for sit down dentistry, which is made by assemblying three cabinet sections. Each cabinet section has internal spaces which are in open communication with the internal spaces of the other cabinet sections. This allows the free passage of utility lines from one cabinet section to another and also permits easy access to the utility lines for installation and repair. The cabinet also can be assembled in place against a wall surface or as a free standing cabinet without the need for utility line excess openings in the walls or back of the cabinet.

9 Claims, 3 Drawing Figures

DENTAL CABINET

BACKGROUND OF THE INVENTION

The present invention relates generally to dental cabinets and more specifically to a free standing cabinet which facilitates the installation of utility service lines into and through the cabinet.

Various cabinet arrangements are used in dental offices. Some of this cabinetry contains various dental hand pieces (pneumatic or electric), syringes, pulp testers and like instrumentation used by the dentist in performing operations within the patient's oral cavity. Other cabinetry may contain other apparatus, such as Bunsen burners, amalgam mixing machines, vacuum apparatus, and the like used by the dentist in performing services associated with the practice of dentistry. Many of these dental apparatus and instruments require some sort of utility supply, either electricity, hot or cold water, gas, or vacuum lines.

Heretofore, the connection of the various utility service lines presented somewhat of a problem. For example, the main utility service line were usually strung across the back of the cabinet and then branch lines were extended into the cabinet through openings at the cabinet rear. In cases, where the cabinetry was free standing, this arrangement required a separate false back or other decorative paneling to be built around the rear of the cabinet to conceal the various utility lines. In cases where the cabinet stood adjacent the wall surface, the usual practice was to run the main utility service lines between the wall and the back of the cabinet and to provide end panels for closing the space between the cabinet and the wall. The construction of dental cabinets of the prior art also made it difficult to provide the necessary internal space needed to make the appropriate utility service connections within the cabinetry. This is a further reason why the practice heretofore has been to run the main utility service lines across the back of the cabinet and to have branch connections extending through the rear wall of the cabinet.

The present invention, however, provides a dental cabinet arrangement which is easily assembled and which not only provides ample internal space for accommodating all required utility service lines, but also provides ready access to these utility lines for making appropriate connections or repairs when necessary. As used herein utility service lines is meant to include waste disposal lines as well as utility supply lines.

SUMMARY OF THE INVENTION

The dental cabinet of the present invention includes separate base, pedestal and storage sections which are joined together to form a free standing cabinet. Each section encloses a relatively large internal space for containing the various utility service lines, the internal space of each section being in open communication with the adjoining section so that the utility line may freely pass from one section to another. In addition, the sides of the base section have appropriate openings so that the main utility service lines can run from one dental cabinet to an adjacent dental cabinet through the base section of each.

DESCRIPTION OF THE PREFERRED EMBODIMENTS

Figure 1:
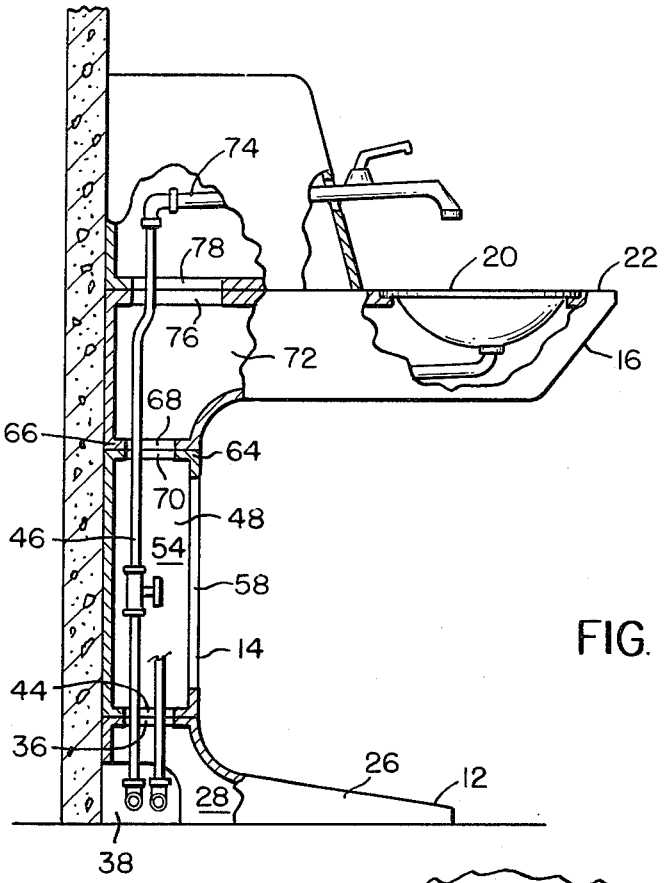
FIG. 1 is a side elevation view partly broken away and in section showing the dental cabinet of the present invention adjacent the wall surface.

Referring to the drawings, FIG. 1 shows the dental cabinet of the present invention generally indicated at 10. This cabinet includes three basic sections, a base 12, a pedestal or intermediate section 14 and a top or storage section 16. If desired, the storage section 16 could be topped with an additional storage section 18.

In the embodiment as shown in FIG. 1, top section 16 is provided with a wash basin 20, however it should be appreciated that top section 16 or the additional storage section 18 could be adapted to accommodate any dental instrument or apparatus requiring a supply of utility service in which case the upper surface 22 of section 16 would be a work table surface. For this reason, it is preferred that the height of surface 22 be sufficient to accommodate a seated dentist or worker. The cantilever construction in such case allows free space beneath cabinet section 16 for the knees of the seated dentist.

Figure 2:
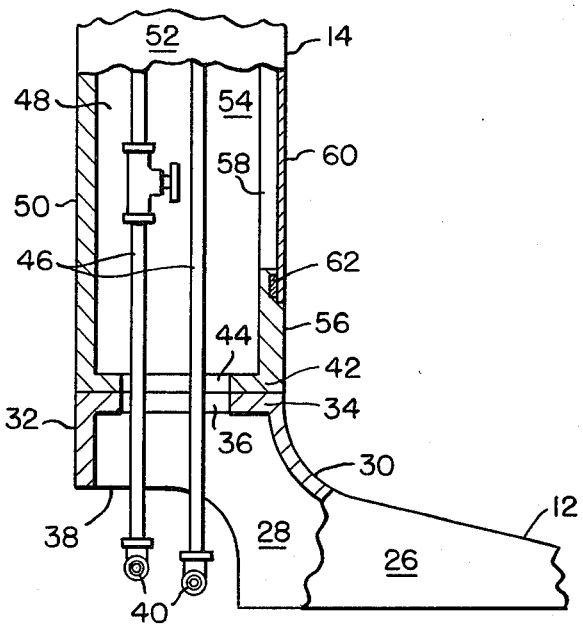
FIG. 2 is a view on an enlarged scale of the lower portion of the dental cabinet.

As best seen in FIG. 2,, base section 12 rests on the floor surface of the dental operatory and has side walls 26, 28. The side walls, together with a front wall 30 form an upstanding portion 32 towards the rear of the base section. The horizontal top 34 of this upstanding portion is provided with an elongated opening 36 for purposes set out hereinbelow.

Figure 3:
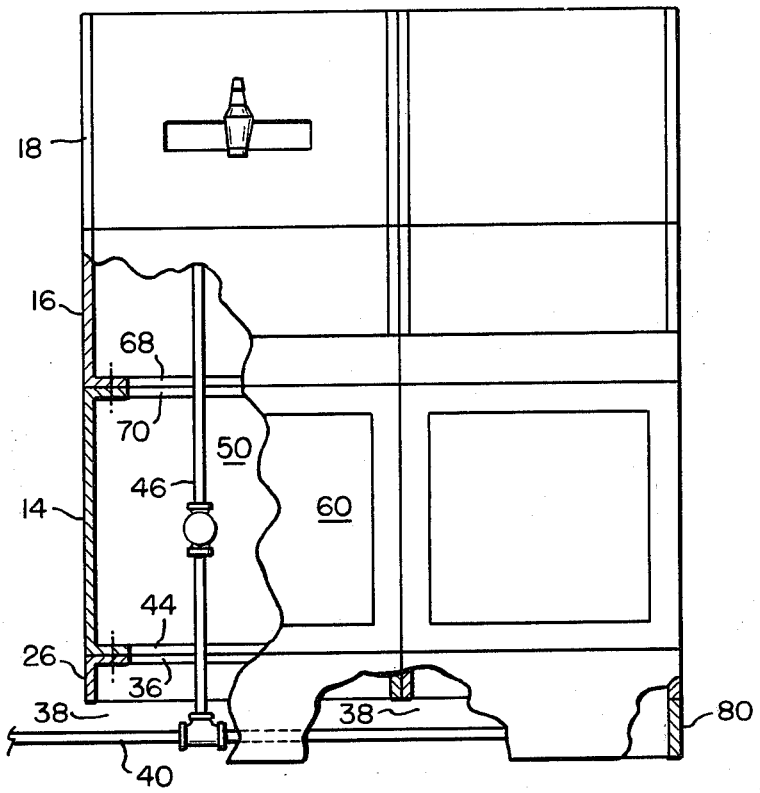
FIG. 3 is a front elevation view of two side by side cabinets with portions broken away to show the internal configuration.

Side walls 26, 28 overhang the bottom 24 of the base at the rear so as to form an opening 38 at each side of the base section. These openings permit the free passage of main utility lines 40 through the internal space of the dental cabinet base 12 and align with corresponding openings in the base of an adjacent cabinet so that the main utility lines 40 can run from one dental cabinet to another as shown for example in FIG. 3. These openings also allow the base section to be placed directly on the floor and over any utility line running across the floor surface even though the utility line is longer than the width of the cabinet.

The pedestal or intermediate section 14 is fixed to the upstanding portion 32 of the base. This can be accomplished by any suitable means such as nuts and bolts (not shown) which extend through both the bottom 42 of the pedestal and the top 34 of the base. Also extending through the pedestal bottom 42 is an elongated opening 44 which aligns with the opening 36 in the base top when the base and pedestal are joined. With this arrangement, branch utility lines as indicated at 46 may pass vertically through the pedestal section and into the base section to directly intersect with the main utility lines at any selected point along that portion of the main utility line which lies between side walls 26, 28.

The interior 48 of the pedestal is an open space defined in part by a pedestal back 50, its two side walls 52, 54 and the pedestal front wall 56. Front wall 56 has a relatively large opening 58 which is closed by a removable panel 60. This panel can be attached to the front wall by any suitable means such as by magnets 62 fixed about the periphery of the panel. With this arrangement, front panel 60 can be easily removed to provide ready access to the branch lines 46 and their various connections and valve so that these may be easily installed and/or repaired.

Referring now to FIG. 1, the top or storage section 16 of the dental cabinet is shown as being mounted in cantilever fashion to the top 64 of the pedestal or intermediate section 14. The connection is made in a fashion similar to the connection of the pedestal to the base, such as by nuts and bolts (not shown) extending through both the top 64 of the pedestal and an adjoining bottom wall 66 of the cabinet section 16.

Both the bottom wall 66 of cabinet section 16 and the top 64 of pedestal 14 have aligned elongated openings 68, 70 respectively, which are in turn, aligned with opening 44 in the bottom of the pedestal and opening 36 in the base. This allows the fluid branch lines 46 to pass vertically from the interior space 48 of the pedestal section and into the interior space 72 of the top or storage section 16 of the dental cabinet. Within cabinet section 16, the utility supply lines can have one or more horizontal branches (not shown) for delivering the utility supply to a point of use.

To facilitate making the necessary utility line connections within cabinet section 16 its top 22 may also be provided with an elongated opening 76 to permit easy access to the internal space 72. If desired, the additional storage cabinet 18 could have a corresponding opening 78 in its bottom so that the utility lines 46 can extend up into the additional storage area. In the embodiment shown one or more horizontal branches 74 of the utility line for deliverying the utility supply (in this case water) to sink 20. However, it should be appreciated that openings 76, 78 make possible the installation of any utility service line in cabinet section 18 such as for air, electricity or vacuum as well as hot and cold water.

Where the dental cabinet of the present invention is to be mounted against the wall surface, as shown for example, in FIG. 1, the main utility supply lines indicated at 40 are simply run across the floor surface next to the wall. This eliminates the need to break into the wall at various points for retrieval of the utility service and makes for quick and easy installation of the main utility lines. Thereafter, base section 12 is pushed against the wall. There is no need to remove or otherwise modify any portion of the base section since the openings 38 in each side wall of the base easily accommodates and provides sufficient clearance for the passage of the main utility line 40. The intermediate or pedestal section is then attached to the base and the vertical branch lines 46 put into position together with any suitable cut off valves, traps or switches or other connections as is required. The relatively large opening 58 at the front of the intermediate section allows for easy and unhindered access for making such connections and for joining the intermediate section to the base section. Top section 16 is then attached to the intermediate section and the branch utility lines extended into the top as is necessary. Thus, the cabinet constructed as the present invention is easily assembled and provides ready access to all utility lines and connections. If desired, the opening 38 of the end cabinets may be provided with a decorative cover plate 80 as shown for example, in FIG. 3.

Similar construction steps can be followed to assemble the cabinet of the present invention as a free standing unit, that is, spaced away from any wall structure. In either case, however, it is also possible to assemble the cabinet sections without the utility lines and make such utility connections as may be necessary after the cabinetry is in place. Also, since the utility lines are all contained within the cabinet structure and ready access is provided between sections for the passage of the utility lines, it should be appreciated that no false back or other unesthetic structures are required to hide or conceal the utility lines. Thus, the present invention provides a cabinet which is pleasing in appearance, easily constructed and which provides ready access to all internal utility lines.

I claim:

1. A dental cabinet having free accesses to utility service lines running through the cabinet, said cabinet comprising:

(a) a base section including a bottom for resting on a floor surface, upstanding sides and a top, said sides each having a portion overhanging said bottom at the rear thereof so that said base can be set down on the floor surface over a horizontal utility line running across the floor surface and through said base, said top having an opening to permit the passage of a vertical branch of said horizontal utility line;

(b) an intermediate section having a top bottom, front, rear and side walls enclosing an internal space, the bottom of said intermediate section resting on and being attachable to the top of said base section and the top and bottom of said intermediate section each having an opening which aligns with the opening in the top of said bottom section so that a vertical branch of said horizontal utility line can pass upwardly through said intermediate section; and (c) a top section having a bottom wall resting on and attachable to the top of said intermediate section, the bottom wall of said top section having an opening which aligns with the opening in the top of said intermediate section so that the vertical branch of said horizontal utility line can pass into said top section.

2. A dental cabinet as in claim 1 wherein the opening in the top of said base is elongated, said elongated opening being located generally in line with said overhanging portions and extending from one side of said base to the other to permit the direct intersection of a vertical utility line branch with the horizontal utility line at substantially any selected point along that portion of the horizontal utility line lying within said base.

3. A dental cabinet as in claim 1 wherein said intermediate section is attached to said base adjacent the rear thereof and directly above said overhanging side portions.

4. A dental cabinet as in claim 3 wherein the openings in the top and bottom of said intermediate section are elongated and extend for substantially the full distance between said side walls, the opening in the top of said base section likewise being elongated, each of said openings being in vertical alignment, whereby a vertical utility line branch extending through said intermediate section can directly intersect with the horizontal line at any selected point along the horizontal line between the upstanding sides of said base.

5. A dental cabinet as set forth in claim 4 wherein:

(a) said intermediate section front wall has an opening which extends over substantially the full area of said front wall; and (b) a removable cover panel for closing said opening whereby removing said cover provides free access to the full internal space of said intermediate section.

6. A dental cabinet as set forth in claim 5 wherein said top section is mounted in cantilever fashion to the top of said intermediate section so as to extend outward over said base section the opening in said bottom wall of said top section being elongated to coincide with the elongated opening in the top of said intermediate section.

7. A dental cabinet comprising:

(a) a base having a bottom for resting on a floor surface, side walls forming an upstanding portion at the rear of said base and a horizontal top to said upstanding portion;

(b) a pedestal section fixed to and upstanding from said horizontal top;

(c) a storage section fixed to and extending in cantilever fashion from the top of said pedestal section;

(d) said pedestal and storage sections each enclosing separate internal spaces for containing utility service lines, said separate spaces being in internal open communication to permit free passage of the utility lines from one of said sections to another;

(e) said horizontal top having an elongated opening to permit passage of a vertical utility service line from said base upwards into the internal space defined by said pedestal; and (f) said side walls each having aligned openings to permit passage of a horizontal utility service line through said base, said aligned openings being located below and in line with said elongated openings so that said vertical and horizontal utility service lines may intersect.

8. A dental cabinet as in claim 7 wherein said pedestal includes a top and a bottom each having an elongated opening which align respectively with the elongated openings in said storage and base sections.

9. A dental cabinet adapted to be located side-by-side to an adjacent cabinet comprising:

(a) a base including a bottom, upstanding sides and a top;

(b) said sides each having aligned openings facing outward through the rear of said base adjacent said bottom to permit location of said base over a horizontal utility main line aligned with said openings and to allow passage of the utility main line through said base;

(c) a pedestal upstanding from adjacent the rear of said base over said aligned openings, said pedestal having side walls, a top and a bottom wherein said pedestal bottom is fixed to said base top;

(d) a storage section extending in cantilever fashion from said pedestal and including a bottom fixed to said pedestal top; and (e) said base top, said pedestal bottom and top and said storage section bottom each having an elongated opening therein which extends substantially the full width of said dental cabinet, said elongated openings being aligned vertically one above the other to accommodate the passage of a utility branch line extending vertically upward from substantially any point along the horizontal utility main line between said base sides.

* * * * *